US007561704B2

(12) United States Patent
Chan

(10) Patent No.: US 7,561,704 B2
(45) Date of Patent: Jul. 14, 2009

(54) STRUCTURE OF SPEAKER

(75) Inventor: Yen-Chen Chan, P.O. Box 108-00403, Taipei 106 (TW)

(73) Assignee: Yen-Chen Chan, Taipei Hsien (TW)

( * ) Notice: Subject to any disclaimer, the term of this patent is extended or adjusted under 35 U.S.C. 154(b) by 804 days.

(21) Appl. No.: 11/164,852

(22) Filed: Dec. 7, 2005

(65) Prior Publication Data

US 2007/0127765 A1 Jun. 7, 2007

(51) Int. Cl.
*H04R 25/00* (2006.01)

(52) U.S. Cl. ..... 381/150; 381/162; 381/423

(58) Field of Classification Search ..... 381/150, 381/162, 396, 398, 423, 432, 433; 181/157, 181/171–173
See application file for complete search history.

(56) References Cited

U.S. PATENT DOCUMENTS 2,049,766 A * 8/1936 Glen ..... 181/157

* cited by examiner

*Primary Examiner*—Brian Ensey
*Assistant Examiner*—Sunita Joshi

(57) ABSTRACT

A speaker, which includes a basket holding an exciter, a holding down ring fastened to the basket to hold down a diaphragm, which has an annular suspension and a cone fastened to the inner diameter of the annular suspension and coupled to the exciter, and a locating plate capped on an annular positioning portion of the exciter and pressed on the center area of the cone with a beveled outer bearing surface to hold down the center area of the cone against vibration in transverse direction to prevent a distortion of sound.

5 Claims, 6 Drawing Sheets

STRUCTURE OF SPEAKER

BACKGROUND OF THE INVENTION

1. Field of the Invention

The present invention relates to speakers and more particularly, to an improved structure of speaker, which guides vibration of the cone in axial direction, preventing horizontal displacement of the cone and a distortion of sound.

2. Description of the Related Art

Since the invention of speaker, speaker has been intensively used in houses, public places, transportable vehicles, electronic products, and etc., for increasing sound. Nowadays, speaker has become one of our daily requisites. Following fast development of technology and change of living style, people are critical to the sound quality of speakers. In addition to the requirement of increasing sound, sound quality is an important factor that must be taken into account when selecting a speaker.

A speaker includes some parts, i.e., an outer basket, a suspension member, a cone and an inner exciter. Every part has a great concern with the performance of the speaker. A conventional speaker comprises a basket, an exciter mounted inside the basket, and a diaphragm suspending in the basket in front of the exciter. The diaphragm comprises an annular suspension and a cone fastened to the inner diameter of the annular suspension. The cone has a center through hole coupled to the exciter. When electricity is connected to the voice coil of the exciter to act against the magnet of the exciter, the cone is caused to vibrate, thereby producing sound.

When in use, the speaker may be set in a transverse (horizontal) position. During operation of the speaker, the cone may also vibration transversely in addition to the normal vibration in axial direction due to the effect of the gravitation, resulting in a distortion of sound.

Therefore, it is desirable to provide a speaker that eliminates the aforesaid problem.

SUMMARY OF THE INVENTION

The present invention has been accomplished under the circumstances in view. It is therefore the main object of the present invention to provide a speaker, which guides the vibration of the cone in axial direction, preventing horizontal displacement of the cone and a distortion of sound. To achieve this and other objects of the present invention, the speaker comprises a basket, the basket defining a receiving open chamber; an exciter positioned in the bottom side inside the receiving open chamber of the basket, the exciter having an annular positioning portion upwardly extending from the center, and a diaphragm fastened to the basket and suspending in the receiving open chamber in front of the exciter, the diaphragm comprising an elastically deformable annular suspension and a cone fastened to the inner diameter of the annular suspension, the cone having a center through hole coupled to the annular positioning portion of the exciter; wherein a locating plate is coupled to the exciter to hold down a center area of the cone, the locating plate having an upright tubular hub coupled to the exciter and an outer bearing portion spaced around the upright tubular hub, the outer bearing portion having a beveled outer bearing surface pressed on the center area of the cone around the center through hole.

DETAILED DESCRIPTION OF THE PREFERRED EMBODIMENT

Figure 1:
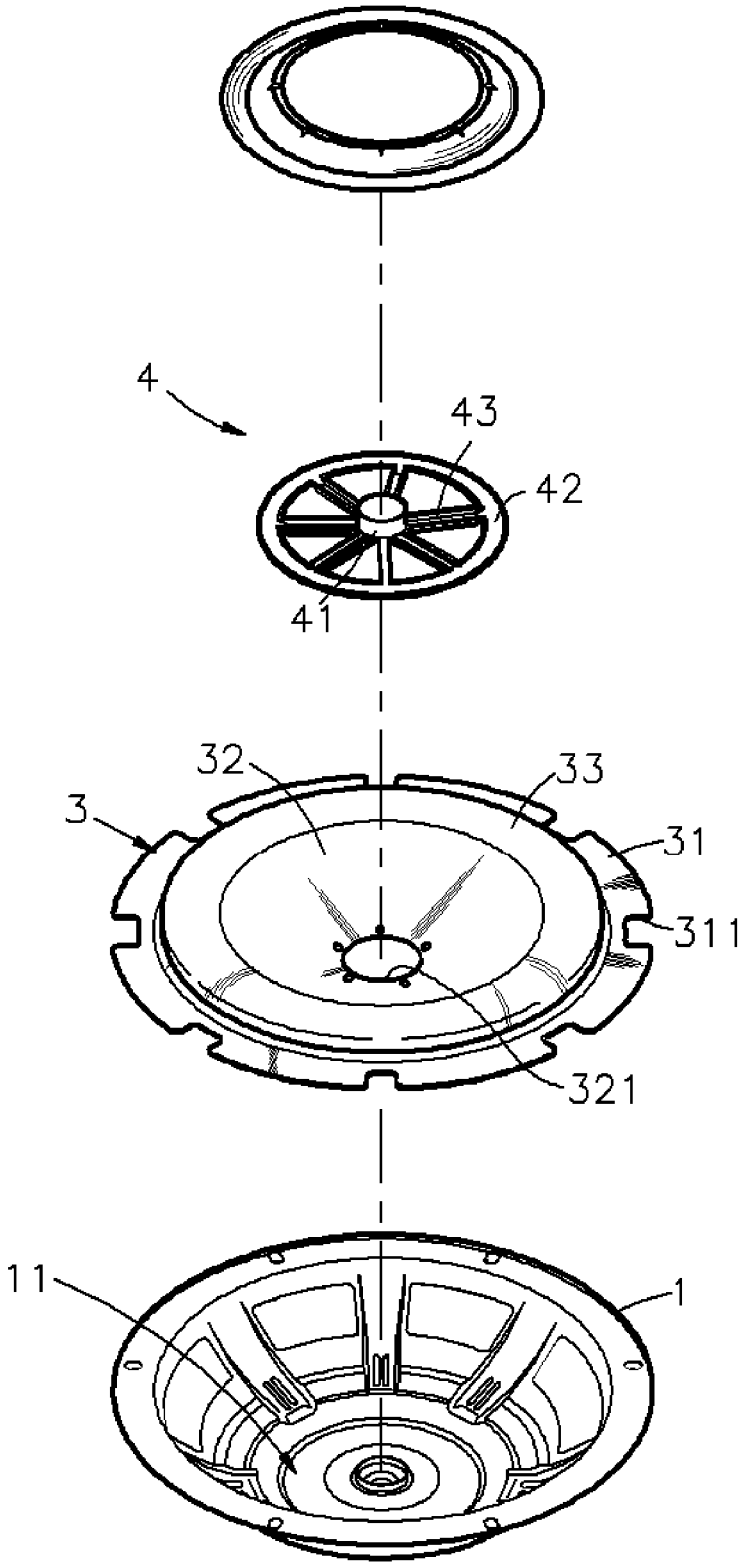
FIG. 1 is an exploded view of a speaker according to the present invention (the holding down ring excluded).
Figure 2:
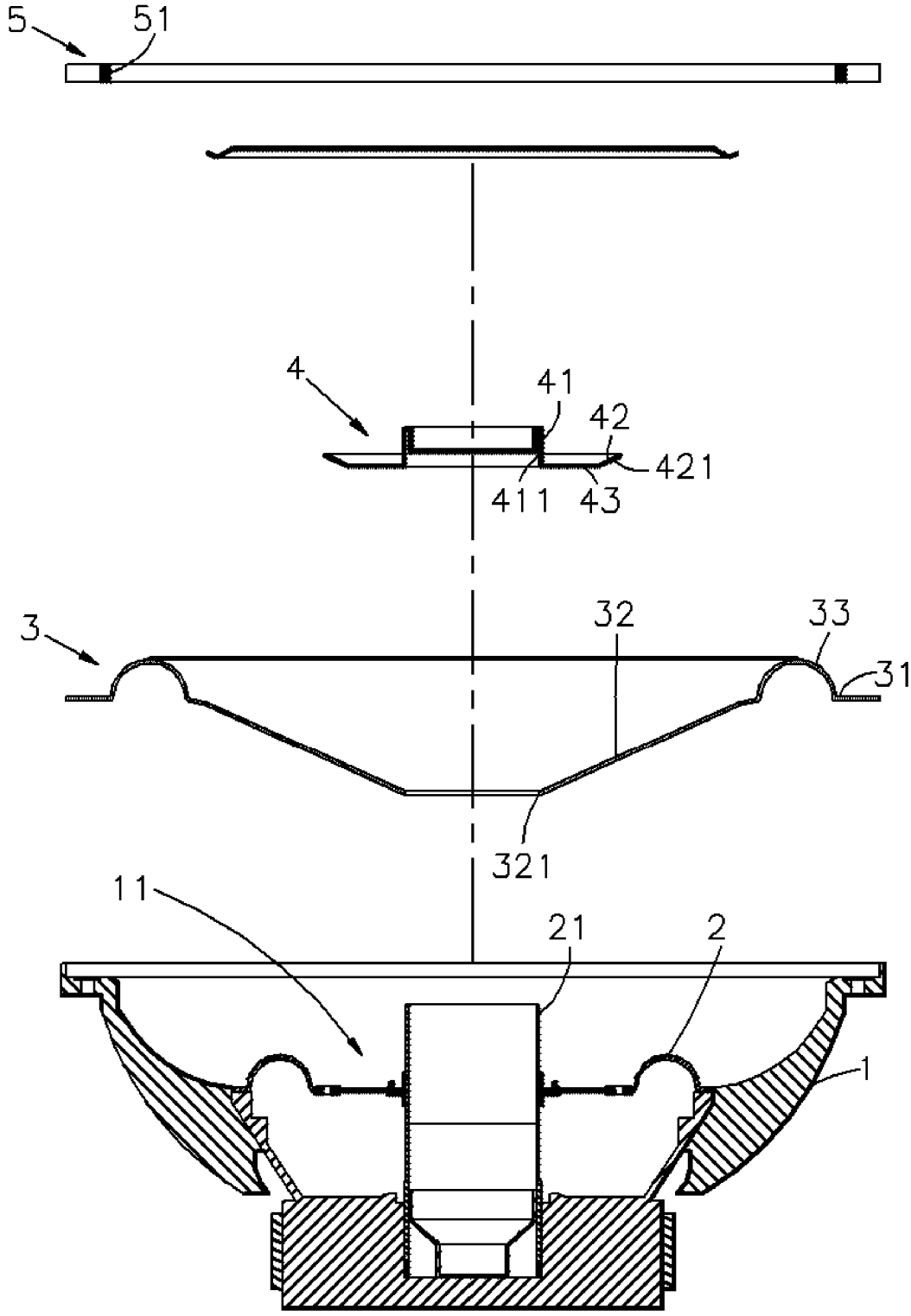
FIG. 2 is an exploded view in section of the speaker according to the present invention.

Referring to FIGS. 1 and 2, a speaker in accordance with the present invention is shown comprised of a basket 1, an exciter 2, a diaphragm 3, a locating plate 4, and a holding down ring 5.

The basket 1 is rounded hollow frame member defining a receiving open chamber 11.

The exciter 2 is positioned in the bottom side inside the receiving open chamber 11 of the basket 1 at the center, having an annular positioning portion 21 upwardly suspending at the center.

The diaphragm 3 comprises an annular suspension 31 that is elastically deformable, and a cone 32 fastened to the inner diameter of the annular suspension 31. The annular suspension 31 has a plurality of locating notches 331 equiangularly spaced around the peripheral edge, and a transversely arched convex surface portion 33 extending between the inner diameter and the outer diameter. The cone 32 has a center through hole 321.

The locating plate 4 has an upright tubular hub 41, an outer bearing portion 42 spaced around the upright tubular hub 41, and a plurality of connecting ribs 43 radially connected between the upright tubular hub 41 and the outer bearing portion 42. The upright tubular hub 41 has an inside annular locating groove 411. The outer bearing portion 42 has a beveled outer bearing surface 421.

The holding down ring 5 has a plurality of bottom lugs 51 corresponding to the locating notches 331 of the annular suspension 31 of the diaphragm 3.

Figure 3:
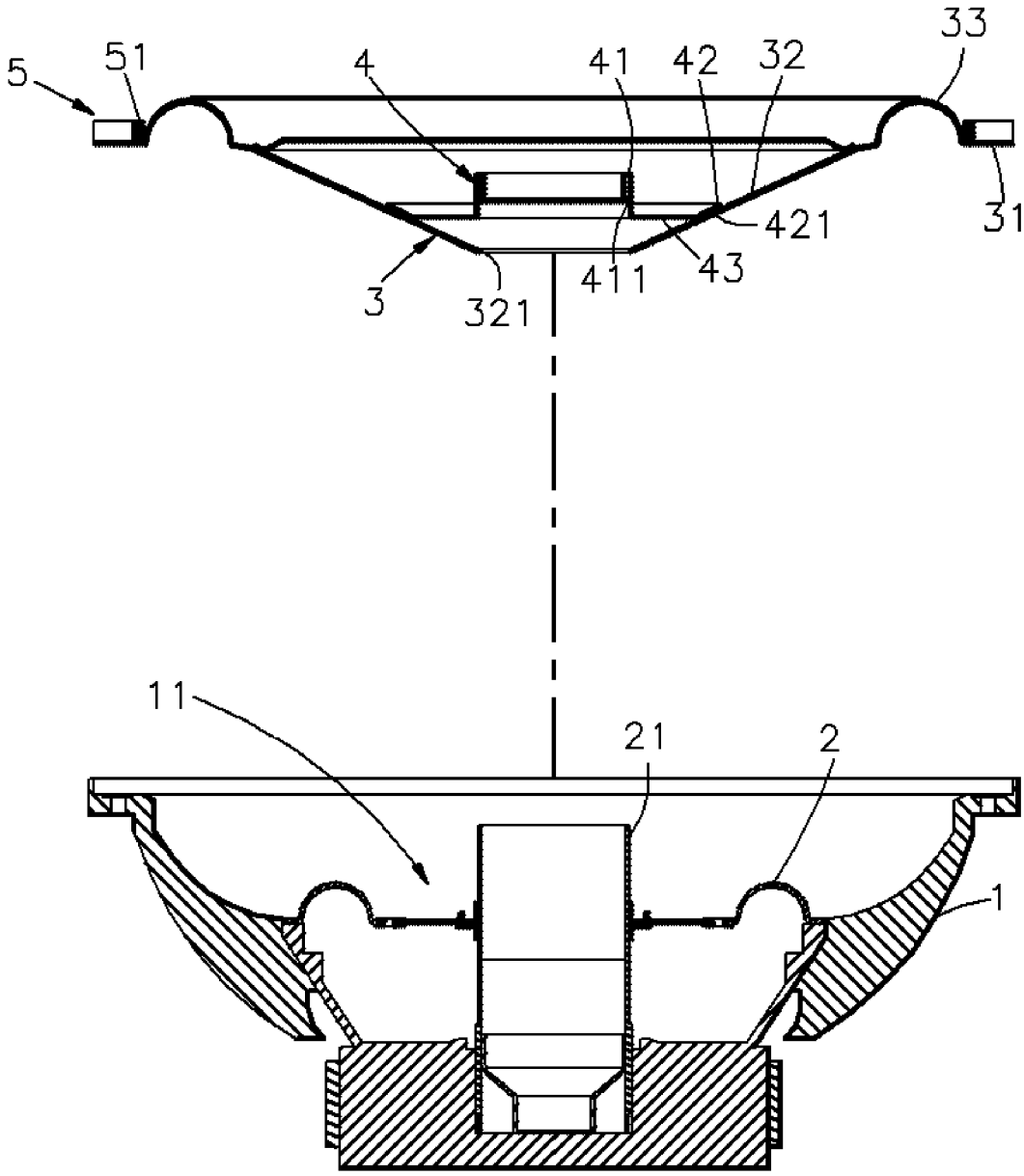
FIG. 3 is another exploded view in section of the speaker according to the present invention.
Figure 4:
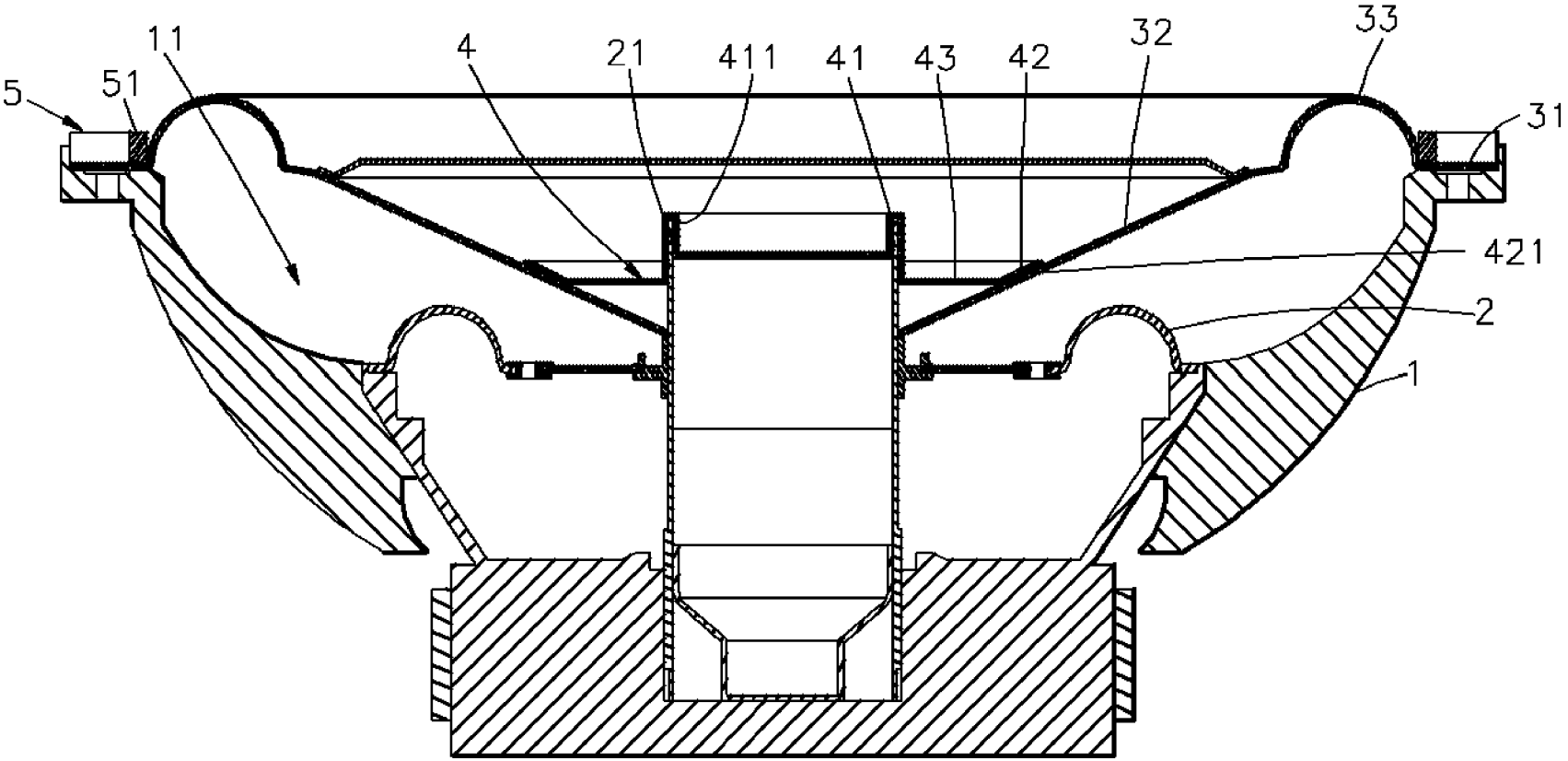
FIG. 4 is a sectional side assembly view of the speaker according to the present invention.
Figure 5:
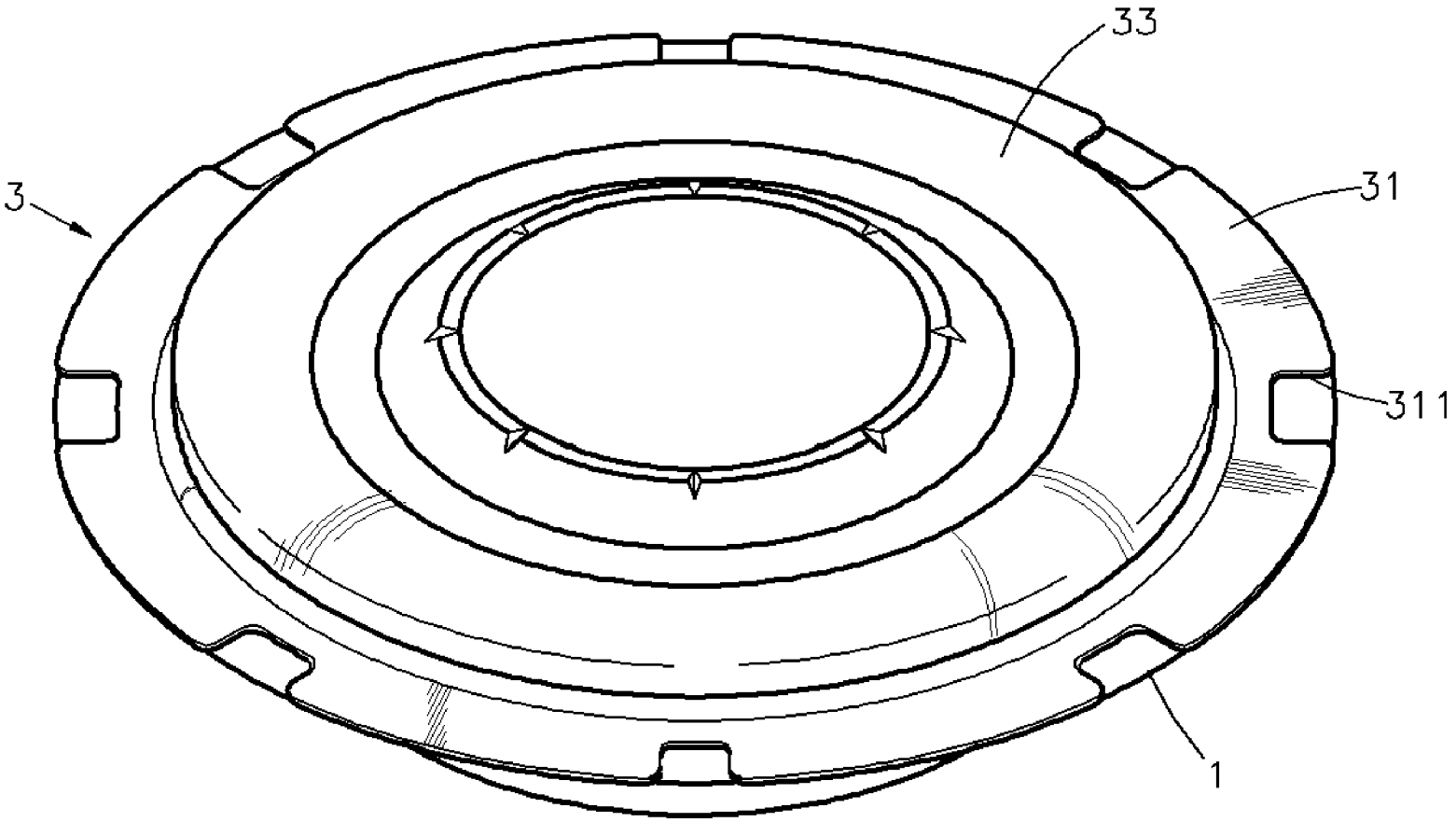
FIG. 5 is an obliquely elevational assembly view of the speaker according to the present invention.

Referring to FIGS. 3~5 and FIG. 2 again, during installation, the diaphragm 3 is set in the receiving open chamber 11 of the basket 1 to couple the center through hole 321 of the cone 32 to the annular positioning portion 21 of the exciter 2 in the basket 1 and to have the peripheral edge of the annular suspension 31 of the diaphragm 3 be supported on the top wall of the basket 1, and then the locating plate 4 is suspended in the cone 32 of the diaphragm 3 to force the inside annular locating groove 411 of the upright tubular hub 41 into engagement with the annular positioning portion 21 of the exciter 2 and to stop the beveled outer bearing surface 421 of the outer bearing portion 42 against the top surface of the cone 32 of the diaphragm 3. At this time, the center through hole 321 of the cone 32 is kept away from the connecting ribs 43 of the locating plate 4 at a distance. Thereafter, the holding down ring 5 is attached to the top surface of the annular suspension 31 of the diaphragm 3 to force the bottom lugs 51 into engagement with the locating notches 331 of the annular suspension 31.

When electricity is connected to the voice coil (not shown) of the exciter 2 to act against the magnet (not shown) of the exciter 2, the diaphragm 3 is vibrated to produce sound. At this time, the cone 32 is alternatively moved up and down relative to an open side of the basket 1 to produce sound, and at the same time the locating plate 4 is moved alternatively up and down with the cone 32. When using a regular speaker, the speaker may be set in a transverse (horizontal) position. Therefore, the cone requires a strong support during working, preventing a side vibration that may cause a distortion of sound. The invention eliminates this problem. By means of coupling the center through hole 321 of the cone 32 to the exciter 2, holding down the annular suspension 31 on the top side of the basket 1 with the holding down ring 5 and stopping the beveled outer bearing surface 421 of the outer bearing portion 42 against the top surface of the cone 32 of the diaphragm 3, therefore the beveled outer bearing surface 421 of the outer bearing portion 42 is kept in contact with the cone 32 through multiple contact points. During working of the exciter 2, the cone 32 is well supported and guided to vibrate in axial direction, and the locating plate 4 is moved with the cone 32. Because the cone 32 has a diameter gradually increasing from the bottom side toward the top side, and the beveled bearing surface 421 is an annular design adhered to the surface of the cone 32, the locating plate 4 prohibits horizontal displacement of the cone 32 during reciprocating motion of the cone 32. Therefore, the invention prevents a distortion of sound.

Figure 6:
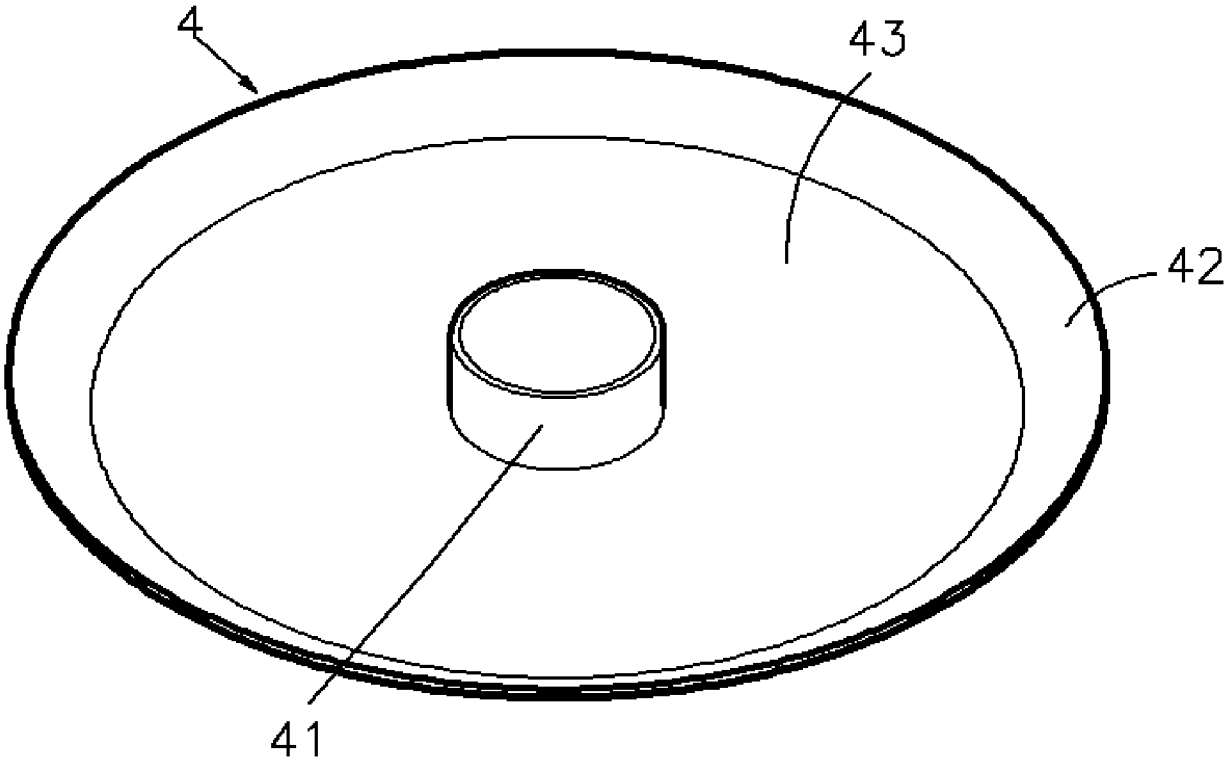
FIG. 6 is an elevational view of an alternate form of the locating plate for the speaker according to the present invention.

FIG. 6 is an elevational view of an alternate form of the locating plate 4. According to this embodiment, the connecting ribs 43 that are provided between the tubular hub 41 and the outer bearing portion 42 of the locating plate 4 are made in the form of a single-piece annular member.

As indicated above, the invention uses the inside annular locating groove 411 of the locating plate 4 for coupling to the annular positioning portion 21 of the exciter 2 to hold down the center area of the cone 32 of the diaphragm 3 on the exciter 2 and to keep the beveled bearing surface 421 of the outer bearing portion 42 of the locating plate 4 stopped against the surface of the cone 32, assuring vibration of the cone 32 in axial direction relative to the basket 1. Therefore, the cone 32 is prohibited from displacement in transverse direction, preventing a distortion of sound.

A prototype of speaker has been constructed with the features of FIGS. 1~6. The speaker functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A speaker comprising:

a basket, said basket defining a receiving open chamber;

an exciter positioned in a bottom side inside said receiving open chamber of said basket, said exciter having an annular positioning portion at the center thereof; and a diaphragm fastened to said basket and suspending in said receiving open chamber in front of said exciter, said diaphragm comprising an elastically deformable annular suspension and a cone fastened to the inner diameter of said annular suspension, said cone having a center through hole coupled to said annular positioning portion of said exciter;

wherein a locating plate is coupled to said exciter to hold down a center area of said cone, said locating plate having an upright tubular hub, said upright tubular hub defining therein an inside annular locating groove coupled to said annular positioning portion of said exciter, an outer bearing portion spaced around said upright tubular hub, said outer bearing portion having a beveled outer bearing surface pressed on a surface of said cone around said center through hole, and a connecting portion connected between said upright tubular hub and said outer bearing portion and spaced from said cone at a distance.

2. The speaker as claimed in claim 1, wherein said connecting portion of said locating plate is formed of a plurality of connecting ribs radially connected between said upright tubular hub and said outer bearing portion.

3. The speaker as claimed in claim 1, wherein said connecting portion of said locating plate is a single-piece annular member connected between said upright tubular hub and said outer bearing portion.

4. The speaker as claimed in claim 1, further comprising a holding down ring pressed on said annular suspension of said diaphragm against a part of said basket.

5. The speaker as claimed in claim 4, wherein said annular suspension of said diaphragm has a plurality of locating notches equiangularly spaced around the periphery thereof; said holding down ring has a plurality of a bottom lugs respectively engaged into said locating notches of said annular suspension.

* * * * *